US007438284B2

(12) United States Patent
McGinness et al.

(10) Patent No.: US 7,438,284 B2
(45) Date of Patent: Oct. 21, 2008

(54) CANTILEVERED RAIL SUPPORT AND COVERING

(75) Inventors: William McGinness, Pinson, AL (US); Maurice Coen, Orange Park, FL (US); Randall Heath, Birmingham, AL (US)

(73) Assignee: Homeland Vinyl Products, Inc., Pinson, AL (US)

( * ) Notice: Subject to any disclaimer, the term of this patent is extended or adjusted under 35 U.S.C. 154(b) by 0 days.

(21) Appl. No.: 11/627,112

(22) Filed: Jan. 25, 2007

(65) Prior Publication Data

US 2008/0179578 A1 Jul. 31, 2008

(51) Int. Cl.
*E04H 17/14* (2006.01)

(52) U.S. Cl. ..... 256/59

(58) Field of Classification Search ..... 256/19, 256/21, 59, 66, 65.07, 65.08
See application file for complete search history.

(56) References Cited

U.S. PATENT DOCUMENTS 3,357,681 A * 12/1967 Thomas, Jr. ..... 256/65.02
3,385,567 A * 5/1968 Case et al. ..... 256/24
3,414,236 A * 12/1968 Siegal ..... 256/22
3,491,984 A * 1/1970 Nyberg ..... 256/21
3,498,589 A * 3/1970 Murdock ..... 256/70
3,804,542 A * 4/1974 Hammerschmidt ..... 403/264
4,014,520 A * 3/1977 Walters ..... 256/22
4,050,828 A * 9/1977 Noro ..... 403/201
4,334,671 A * 6/1982 De Guise ..... 256/65.12
4,390,164 A * 6/1983 Cokelekoglu ..... 256/65.13
4,451,025 A * 5/1984 Spera ..... 256/65.12
4,805,879 A * 2/1989 Spera ..... 256/65.12
5,713,171 A * 2/1998 Andres ..... 52/263
6,874,766 B2 * 4/2005 Curatolo ..... 256/59
7,048,259 B2 * 5/2006 Quaintance et al. ..... 256/65.06
7,216,855 B2 * 5/2007 Platt ..... 256/65.03
2005/0017232 A1 * 1/2005 Chen ..... 256/59

* cited by examiner

*Primary Examiner*—Daniel P. Stodola
*Assistant Examiner*—Joshua T Kennedy
(74) *Attorney, Agent, or Firm*—Smith, Gambrell & Russell

(57) ABSTRACT

A rail structure for use as a handrail or as part of a fence or guardrail construction. The rail has a rigid channel shaped support member and upper and lower rail caps to enclose the support member with a durable decorative appearance. The cantilever provided by flanges on the support member permit upper and lower rail caps to be snap fit to the support member.

15 Claims, 11 Drawing Sheets

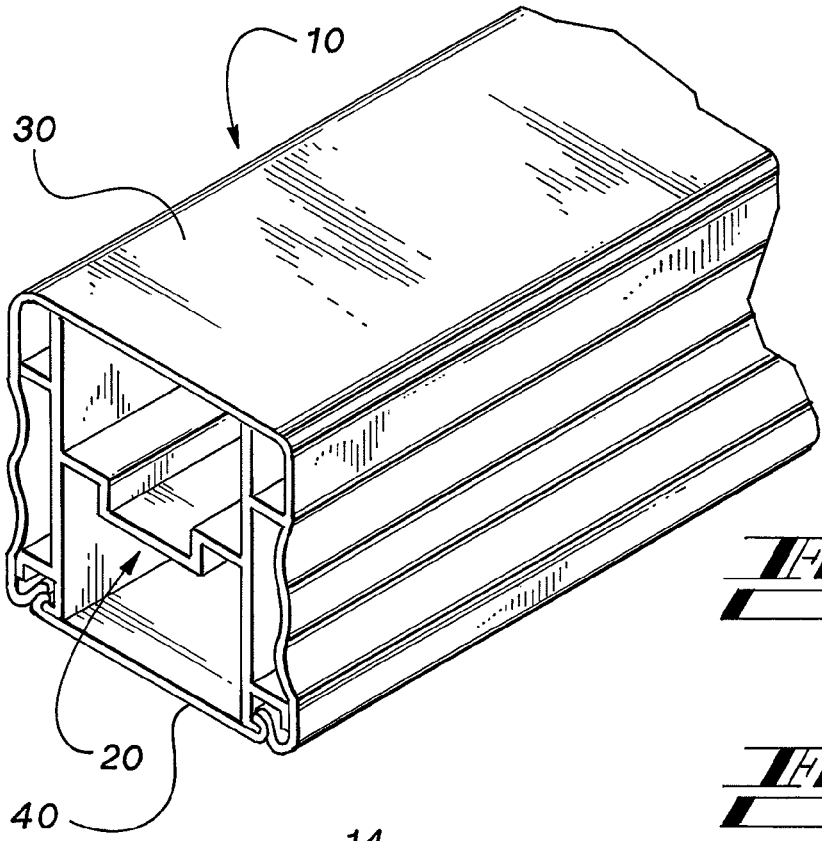
Fig_1
Fig_2
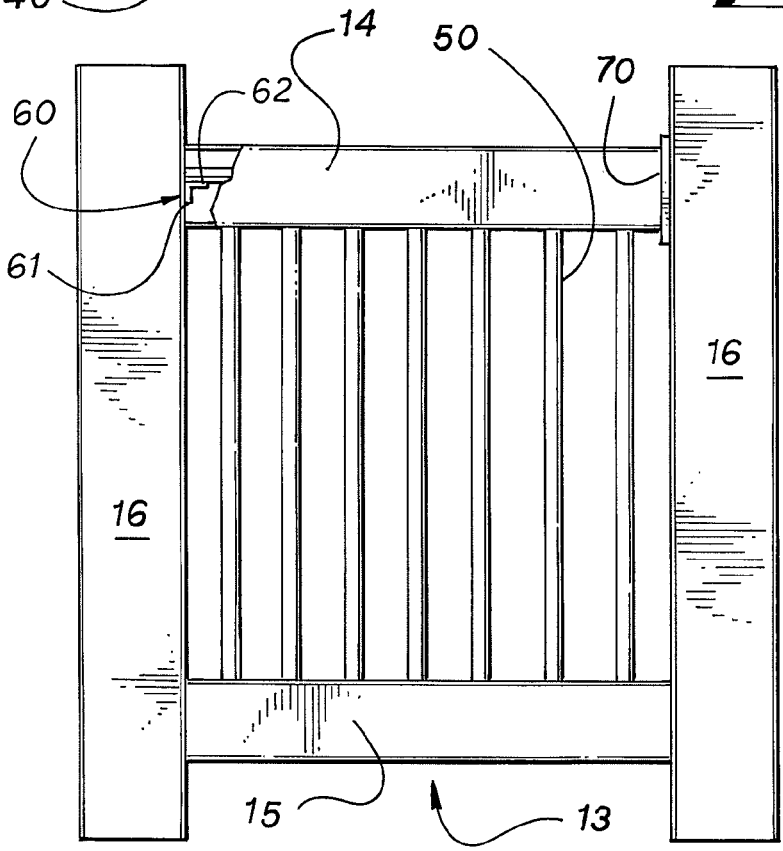

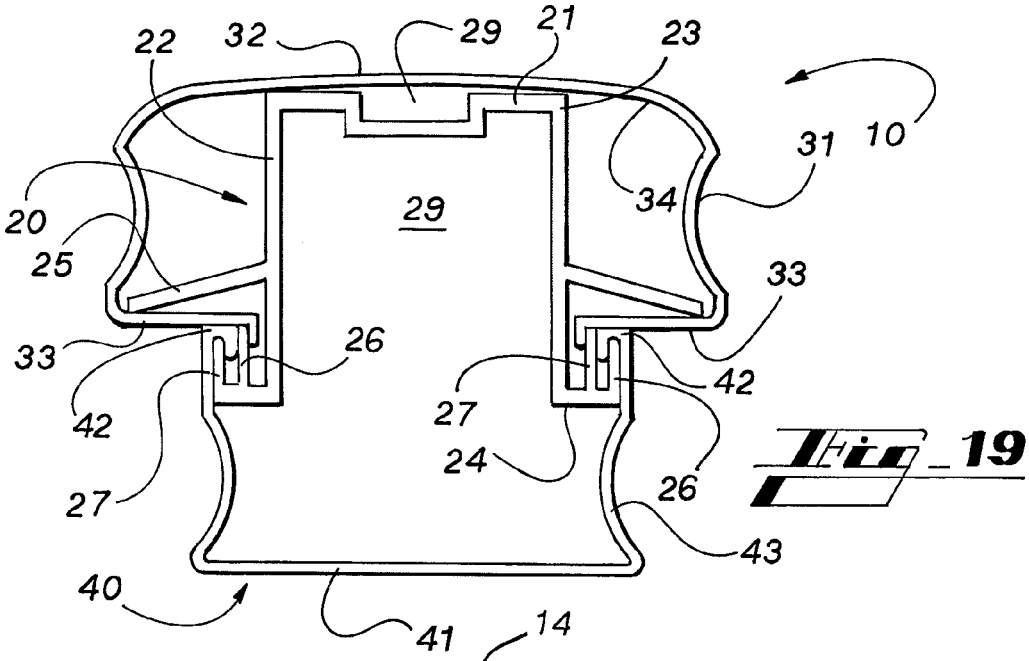
Fig_19
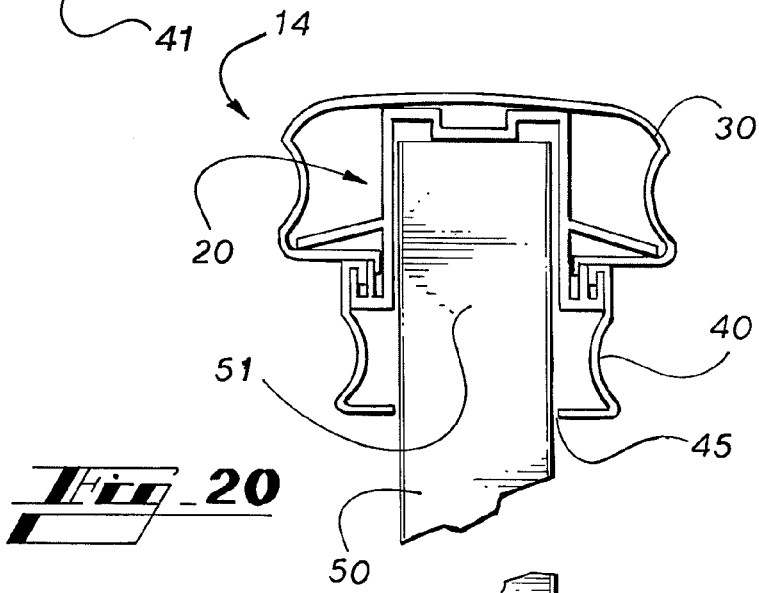
Fig_20
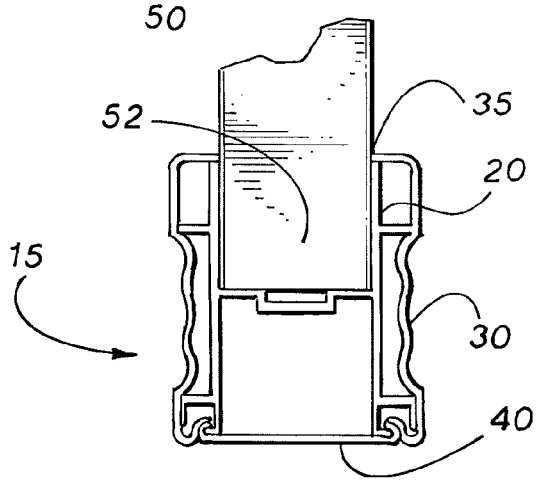

40
30
20

40
42
20
41
41
25
21
26
28
22
22
29
27
33
33
31
30
34
32

CANTILEVERED RAIL SUPPORT AND COVERING

FIELD OF THE INVENTION

The present invention relates generally to the field of fences and guard rails. More particularly, the invention relates to containment and decorative fences and guardrails having a vinyl covering. With even greater particularity, the present invention relates to a method of assembling and components for providing a vinyl covering over a substrate support structure for a fence or guard rail.

BACKGROUND OF THE INVENTION

In the art of fences numerous materials and methods have been employed to construct and design fences for various purposes such as containment of livestock, pets, people and the like or for the exclusion of the same. Similarly, guardrails have been employed for the containment or protection of people from hazards. For example, guardrails are commonly utilized on balconies and stairways in high rise apartments, hotel accommodations, office complexes, shopping malls, single family dwellings, and the like. In other instances, fences and guardrails may be employed to add a decorative or aesthetic flourish to such structures and landscapes, and may be found in both interior and exterior applications.

A commonly used fence or guardrail configuration is a rail and spindle design, wherein the fence or guardrail generally comprises upper and lower horizontally disposed rails and a plurality of spindles, vertically disposed between the rails and spaced apart. This common configuration lends itself to construction with numerous materials, depending upon the desired application. For example, a guardrail for a patio deck may simply be constructed with treated lumber, the rails generally being 2"×4" boards, and the spindles being 1"×1" boards. By contrast, a guardrail for an interior balcony or stairway, may be elegantly constructed of finely finished hardwoods, polished brass, and the like. Wrought iron, aluminum, and the like are other common materials for such guardrails and fences.

Construction of a guardrail or fence with the traditional materials and methods may also be prohibitive. For example, the aforementioned deck, while simple in design, generally requires that that the spindles be nailed or otherwise attached to the upper and lower rails. More elaborate designs require significant labor, skill, and machinery to perform the necessary millwork or machining on the rails so that the spindles may be received in a aperture or hole, defined in each of the rails. In the case of wrought iron and similar materials, each of the many spindles must be welded to the rails.

For each of these materials, it is desirable that the guardrail or fence be appropriately finished to maintain an attractive appearance and coordinate with the surrounding color scheme or décor. Similarly, particularly in exterior applications, a finish aids in protecting the underlying materials from deterioration as they may be exposed to environmental hazards such as moisture, sun, pollutants, and the like. As the respective finishes are exposed to the elements, they may become weathered, rust, fade, flake and otherwise deteriorate in appearance requiring considerable expense and effort to restore the attractive appearance and protective qualities of the finish. Similarly, should the property owner desire to change the color scheme or décor of the associated structure or landscape, the finish of these materials must be changed to coordinate with the new décor, again requiring considerable expense and effort. Should the property owner desire to significantly alter the décor, the fencing or guardrails may need to be entirely replaced at great expense to the property owner, as the appearance of the fencing is incapable of being modified.

More recently, vinyl, plastics and similar such materials have been found to be advantageous for such applications. They provide a convenient material due to their ease of fabrication, light weight, relative cost, and their ability to maintain an attractive appearance, particularly for exterior fencing and guardrail applications. However, a significant disadvantage of these materials is that many building codes do not approve of their use in applications requiring structural or protective support. Accordingly, their application remains limited due to these restrictions. Should the property owner desire to change the color scheme, these materials possess an added disadvantage in that it is difficult to get paints to reliably adhere to these materials when it is desired to change their color. As with other traditional material, they must be entirely replaced in order to change their design or appearance.

BRIEF SUMMARY OF THE INVENTION

The present invention solves many of the aforementioned problems with existing fence and guard rail materials and construction methods. The invention may be generally described as a rail and spindle fence, and comprises a substrate support member which provides support and structure for the rail. The support member may be formed of a metallic, composite, or other approved construction material, and is preferably made of aluminum. The support member has a channel shaped construction with a plurality of flanges extending outwardly from the channel. An upper rail cap is provided to overlay and substantially enclose the support member and may be shaped to a desired decorative appearance. The upper rail cap is further provided with a plurality of flanges or J-hooks that interlock with a corresponding flange of the underlying substrate support member, permitting the upper rail cap to be quickly yet removably secured to the support member without adhesives, screws, or other type fastening means. A lower rail cap encloses the remainder of the support member, and is also formed with a plurality of flanges or hooks that interlock with a corresponding flange of the support member. As with the upper rail cap, the lower rail cap may be shaped to a desired decorative appearance to coordinate with the design or décor of the particular installation. Upper and lower rail caps may be made of plastic, composite, or metallic materials, and are preferably made of vinyl. An advantage of plastics and vinyl in particular is that the components may be fabricated in a wide variety of colors having a durable finish.

The above described rail may be used individually, as for example a hand rail, in which case, the rail is attached to a wall by brackets. The rail may also be used in combination with a second rail and associated spindles to construct a fence or guardrail section. In this instance, a first rail is provided to define a top of the fence section and a second rail is provided to define the bottom of a fence section. A plurality of spindles are provided in vertical orientation and disposed spaced apart between the first and second rails. When so arranged a plurality of apertures are defined in the outer surface of the inwardly facing rail caps, namely the lower rail cap of the first rail and the upper rail cap of the second rail. The apertures in the rails receive the ends of the spindles, holding the spindles in their vertical spaced apart relation. The ends of the spindles extending through the apertures are received in the channel defined in the respective support members of the first and second rails, securing the spindles therein.

Opposed pairs of generally L-shaped brackets are utilized to attach the fence or guardrail section between two vertical supports, such as a fence post, or opposed walls of an opening in a structure, such as on a balcony. The brackets are fastened to the ends of the support members to secure the section in place.

BRIEF DESCRIPTION OF THE SEVERAL VIEWS OF THE DRAWINGS

FIG. 1 depicts a perspective view of a rail according to the present invention;

FIG. 2 depicts an application of a rail utilized as a fence or guardrail section;

FIG. 19 depicts a cross sectional view of an alternative embodiment of an assembled rail;

FIG. 20 depicts a cross sectional view of a pair of rails with a spindle extending between the rails;

DETAILED DESCRIPTION OF THE INVENTION

Figure 3:
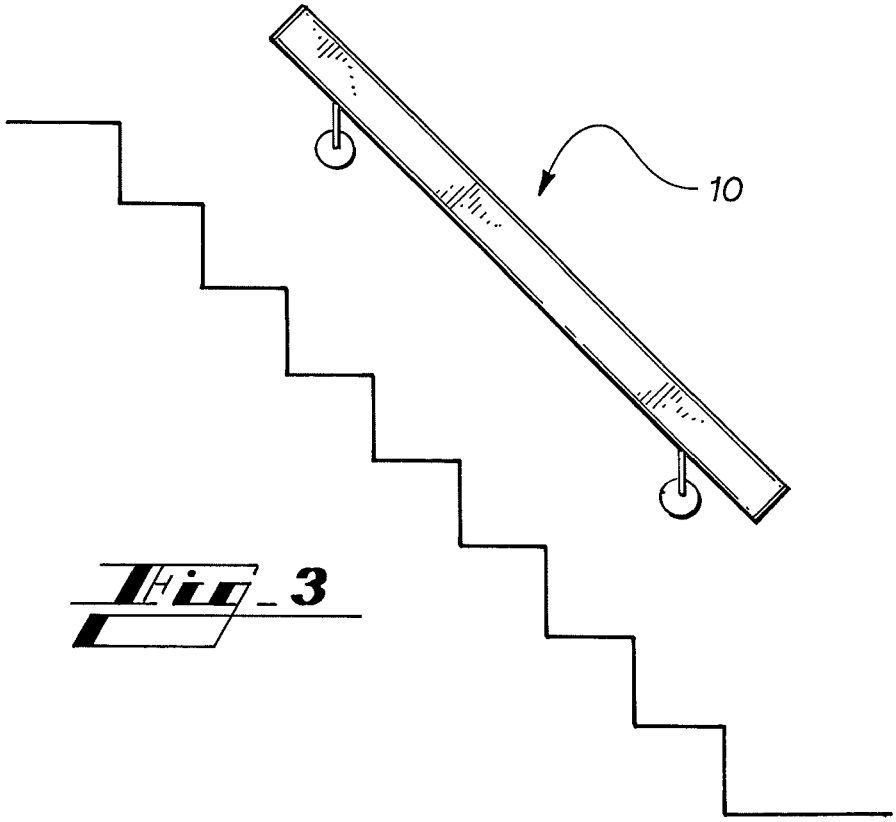
FIG. 3 depicts frontal view of an application of a rail used as a handrail.

Referring to the drawings for a more complete description of the invention, FIG. 1 depicts a an elongate rail 10 constructed according to the present invention. Rail 10 comprises a substrate support member 20 which provides support and structure for the rail 10, an upper rail cap 30, and a lower rail cap 40, substantially enclose and operatively attach to support member 20. Upper rail cap 30 and lower rail cap 40 may be appropriately shaped to give rail 10 a desired outward appearance. As may be seen in FIGS. 3 and 4 a rail 10 may be employed singly as, for example, a hand rail, and attached by standard brackets 11 to a wall 12 or other support structure as will be familiar to those of skill in the art. As may be seen in FIG. 2, a pair of rails 10 may be used to form a fence or guardrail section 13, with rails 10 in opposed relation and plurality of spindles 50 spaced apart and extending between a first rail 14 and a second rail 15, spindles 50 being generally vertically disposed and rails 14 & 15 being generally horizontally disposed. Fence or guardrail section 13 may be attached to opposed walls of a structure 16, such as in a balcony, or between posts 16, such as in a fence, or in a combination thereof.

Figure 7:
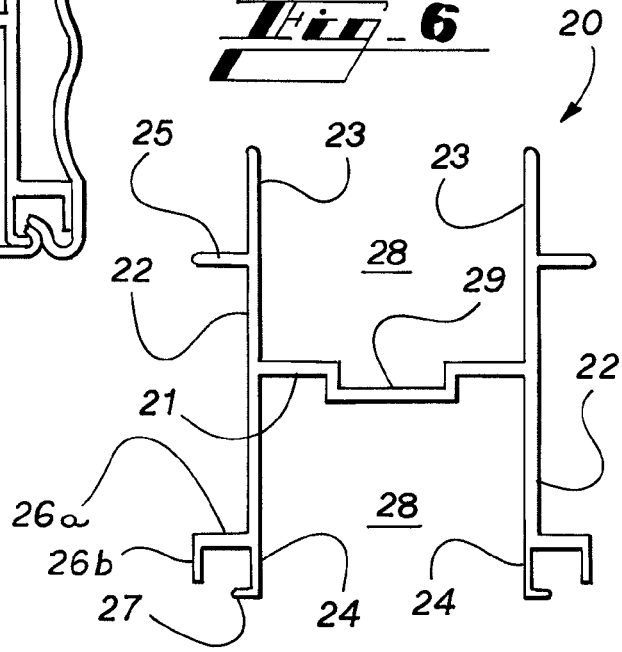
FIG. 7 depicts a cross sectional view of a support member.

The support member 20 is comprised of a metallic, composite, or other approved construction material according to applicable building codes, and is preferably made of aluminum. The support member 20 has a channel forming construction with a plurality of flanges extending outwardly from the outer walls of the channel 28. As may be seen in a first preferred embodiment, such as that shown in FIGS. 1 & 7, support member 20 is substantially H-shaped and comprises a cross piece 21 interconnecting a pair of vertical extensions 22 between the upper end 23 and lower end 24 of extensions 22. Channels 28 are defined by cross piece 21 and extensions 22 in the support members 20. Cross piece 21 may be modified such that a secondary channel 29 is defined at a midpoint of cross piece 21. A first flange 25 extends outwardly from vertical extensions 22, proximal upper ends 23. A second flange 26, is generally L-shaped, having a leg **26*a* extending outwardly from vertical extensions 22 proximal lower end 24, with a base 26*b* of the L shape extending downwardly from the end of leg 26*a*. A third flange 27 extends outwardly of vertical extensions 22 and below second flange 26. Preferably, first, second, and third flanges 25, 26, 27 extend along the entire length of support member 20**.

Rail 20 is mounted to structure 16 or a fence post 16 by a plurality of brackets 60. A preferred bracket 60 is substantially L-shaped and have base 61 and a leg 62. A plurality of holes or slots 61 are defined in base 61 and are dimensioned to receive a pin, bolt, screw or the like for attachment of base 61 to the wall 16 or fence post 16. Leg 62 is preferably dimensioned to correspond to the width of channel 28 the legs 62 are received in channel 28 and engage cross pieces 21 in a supporting relation. Legs 62 should also have a plurality of holes or slots 61 defined therein such that support members may be secured to bracket 60 by, pins, bolts, or screws.

Upper cap 30 has what can generally be described as an inverted U-shape, defined by a pair of legs 31 interconnected by an intermediate portion 32. A pair of shaped flanges 33, described generally as J-hooks, extend inwardly from the ends of legs 31, with the ends of shaped flanges 33 adapted for engagement with base **26*b* of second flange 26. More preferably shaped flange 33 will have a lip 36 extending inwardly towards a centerline of upper cap 30, such that lip 36 will engage a hook 42 of lower cap 40. Upper cap 30 substantially encloses the support member 20 and may be shaped to a desired decorative appearance as may be seen in reference to FIGS. 5, 9-12. As with the flanges 25, 26, & 27 of support member 20, shaped flanges 33 and lip 36 preferably extend along the entire length of upper cap 30. Upper cap 30 and first flanges 25 are preferably dimensioned such that the ends of first flanges 25 are in abutment with an inner wall 34 of legs 31, and the upper ends 23 of vertical extensions 22 engage an inner wall 34 of intermediate portion 32**.

Figure 8:
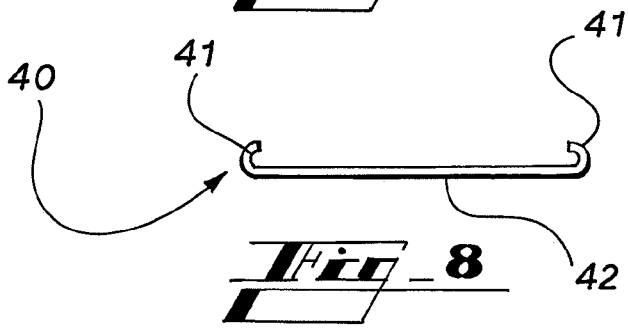
FIG. 8 depicts a cross sectional view of a lower rail cap.
Figure 9:
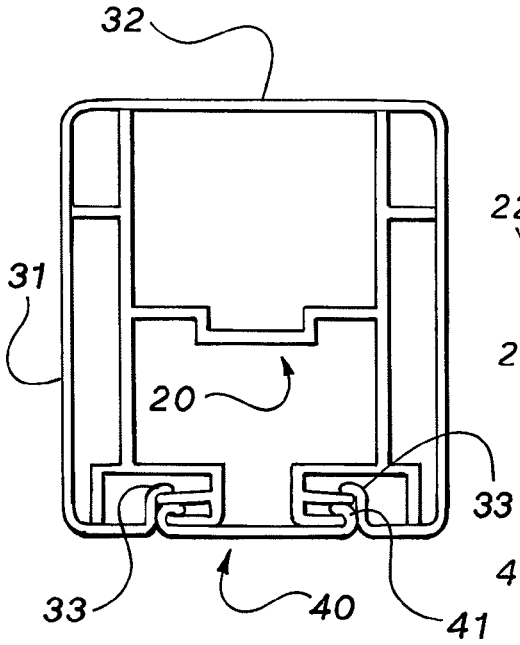
FIG. 9 depicts a cross sectional view of an alternative embodiment of a rail having flat sides.
Figure 10:
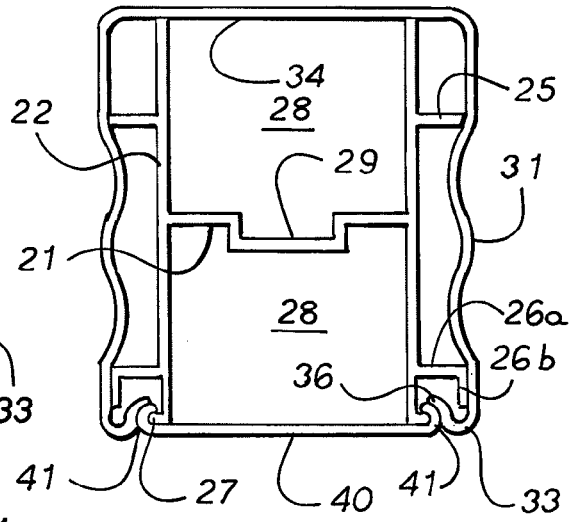
FIG. 10 depicts a cross sectional view of an alternative embodiment of a rail having a plurality of grooves.

Lower rail cap 40 is provided to enclose the remainder of the support member 20. In a preferred embodiment shown in FIGS. 1 & 8, lower rail cap 40 comprises a substantially flat inner portion 41 and a pair of hooks 42 formed at the ends thereof, with the hooks 42 turned inwardly towards a centerline of lower rail cap 40. Hooks 42 are adapted to engage third flange 27.

As may be seen from the drawings, upper cap 30 and lower cap 40 are attached to support member 20, such that they enclose support member 20 in a durable decorative shell. Upper 30 and lower 40 rail caps may be made of plastic, composite, or metallic materials, and are preferably made of vinyl. More preferably, upper 30 and lower 40 rail caps are formed from sheet vinyl, which permits the fabrication of extended lengths of caps 30 & 40 such that they may enclose a desired length of support member 20 without an unsightly seam along the length of the rail 10 or without the creation of excessive waste materials that would otherwise be generated by cutting a standard length of material to match a particular support member 10 length.

It will be appreciated that a rail 10 constructed according to the present invention may be constructed to have virtually any outward appearance, while permitting the rail 10 to be quickly and easily assembled without the need of special tools, fasteners, or adhesives. According to the invention contemplated, the rail may be quickly assembled by simply snap fitting the respective upper and lower rail caps 30 & 40 to the support member 20 to provide the desired fully assembled rail 10.

Figure 4:
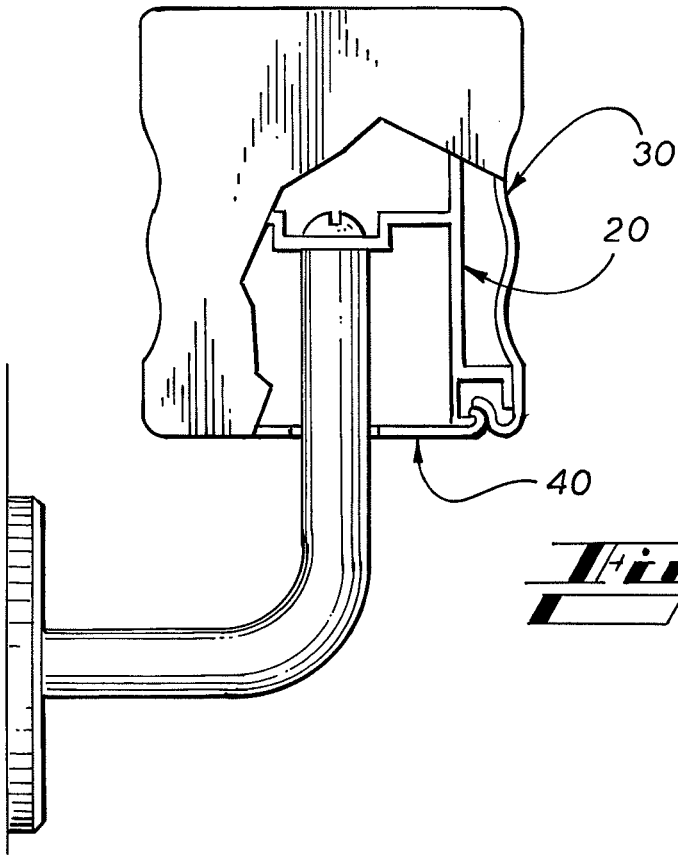
FIG. 4 depicts an end view of an application of a rail used as a handrail.
Figure 5:
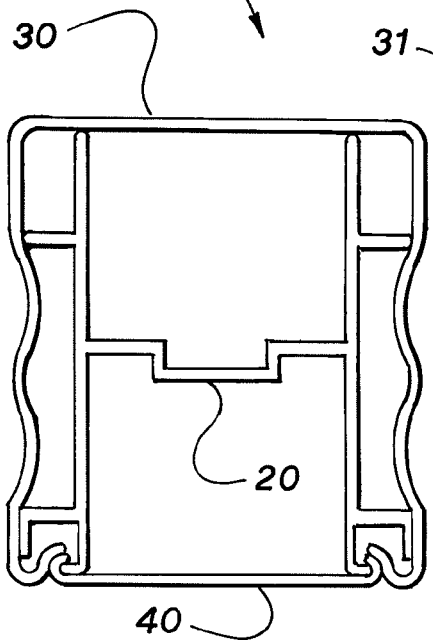
FIG. 5 depicts cross sectional view of a rail.
Figure 6:
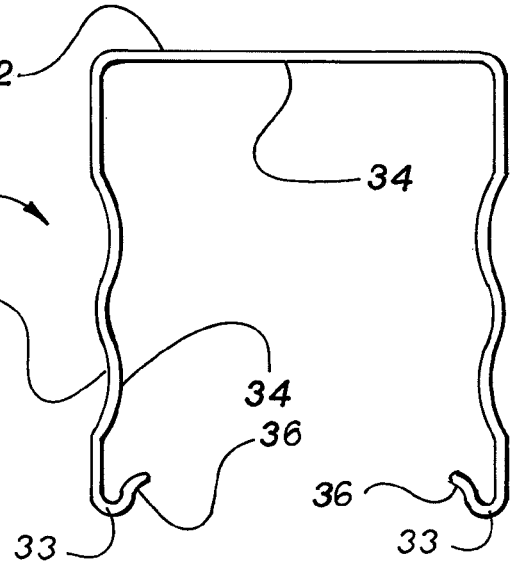
FIG. 6 depicts a cross sectional view of an upper rail cap.

As described previously, rail 10 may be used individually for applications such as the handrail shown in FIGS. 3 and 4. More preferably, a first rail 14 is used in combination with a second rail 15 and associated spindles 50 to construct a fence or guardrail section 13. As may be seen in FIG. 2, a pair of rails 10 may be used to form a fence or guardrail section 13, with rails 14 & 15 in opposed relation and plurality of spindles 50 spaced apart and extending between first rail 14 and second rail 15, spindles 50 being generally vertically disposed and rails 14 & 15 being generally horizontally disposed. Spindles 50 may have any appropriate design, such as a simple square or rounded cylinders and may even be made with more elaborate scrolled, fluted, or turned appearance.

In constructing a fence section 13 according to the present invention, the caps 30 & 40 are appropriately modified, wherein spindles 50 are received in a plurality of spindle apertures 35 and 45 defined through opposed faces of the inwardly facing rail caps, that is the lower rail cap 40 of the first rail 14 and the upper rail cap 30 of the second rail 15. It will also be appreciated that one of either the first 14 or second rail 15, could be rotated such that, the inwardly facing rail caps could both have what have been described as upper 30 and lower 40 rail caps. The apertures 35 & 45 are dimensioned to receive the ends 51 & 52 of spindles 50, and are disposed along a centerline of the respective rail caps 40 and 30 at selected points to obtain a desired spacing between adjacent spindles 50. As may be seen in FIG. 20, the ends 51 & 52 of the spindles 50 extend through the apertures 35, 45 and are received in channel 28 of the first 14 and second rails 15. Preferably, the ends 51 & 52 of the spindle are dimensioned such that they form a close fit within apertures 35 & 45 and within channels 28.

A second exemplary embodiment of the rail 10 of the present invention may be seen in reference to FIGS. 16-19, in which like elements are labeled according to their common numbers. Rail 10 is shown with a support member 20, generally having a bridge shape defined by a cross piece 21 and pair of opposed vertical extensions 22 extend at a first or upper end 23 from the ends of cross piece 21, with the inner walls of cross piece 21 and extensions 22 defining a channel 28. Extensions 22 each have first flanges 25 extending outwardly from extensions 22. A second flange 26 extends upwardly from a lower outwardly turned ends 24 of extensions 22. A third flange 27 extends upwardly from lower end 24.

Figures 24A, 24B:
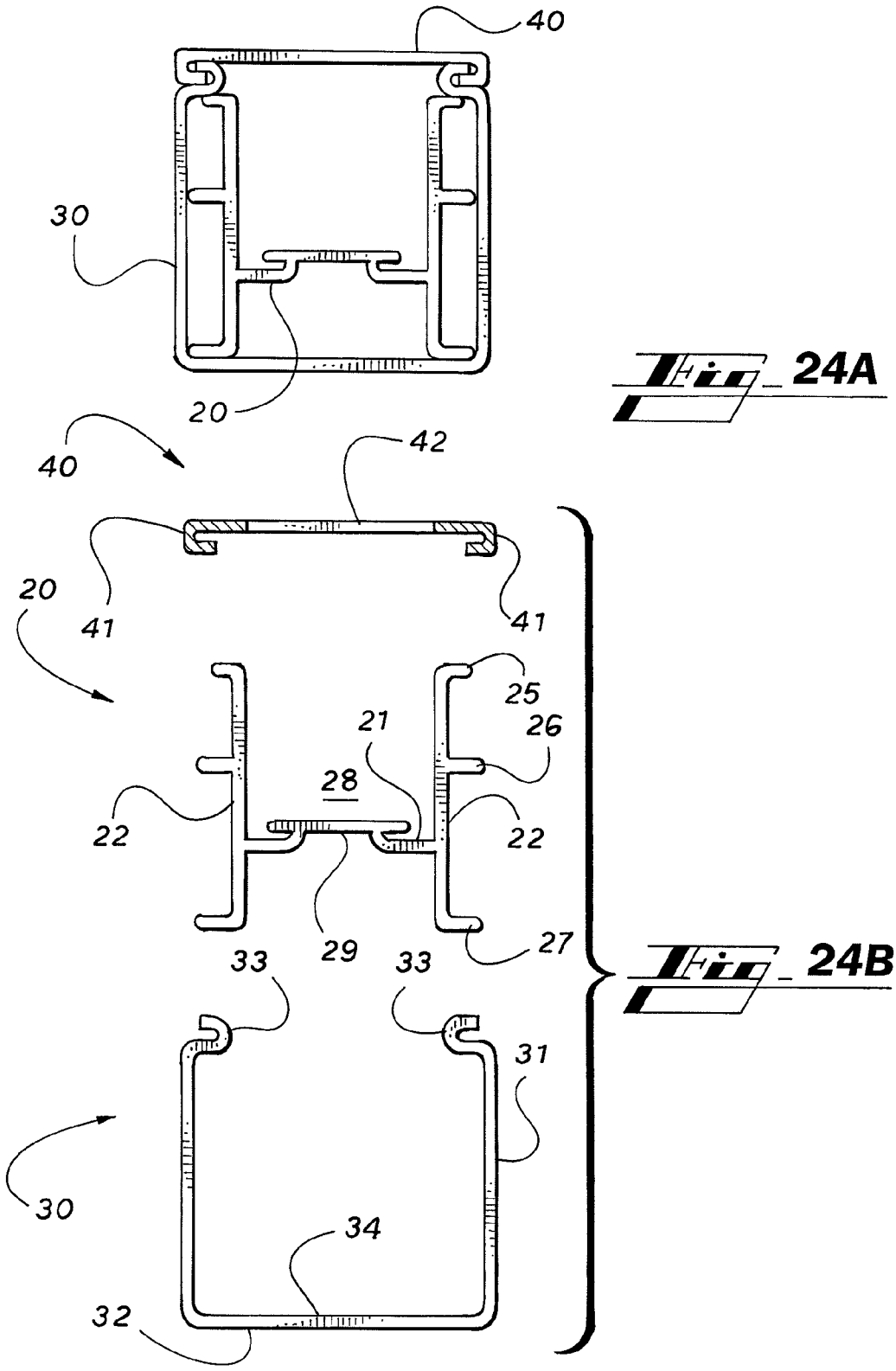
FIG. 24A depicts an end view of a cantilevered rail support and covering.
FIG. 24B depicts an expanded view of a cantilevered rail support and covering.

A preferred embodiment is shown in reference to FIGS. 24A and 24B. Support member 20 is preferably substantially H-shaped and comprises a cross piece 21 interconnecting a pair of vertical extensions 22 between the upper end and lower end of extensions 22. In this embodiment, support member 20 has a first set of paired flanges 25, a second set of paired flanges 26, and an optional third set of paired flanges 27. In this preferred embodiment of the invention, flanges 25, 26, and 27 are more like ribs in that they do not necessarily have additional appendages extending from their ends. As may be seen in reference to FIGS. 24A-B and 26, first flange 26 extends outwardly by an amount slightly less than that of second flange 26.

In this embodiment, the first rail cap 40 is shaped substantially the same as the lower rail cap 40 previously described, and has a pair of inwardly turned hooked ends 42 extending from inner portion 41. Second rail cap 30 is shaped substantially the same as the upper rail cap 30 previously described. Second rail cap 30 has a generally inverted U-shape, defined by a pair of legs 31 interconnected by an intermediate portion 32. A pair of shaped flanges 33, described generally as J-hooks, are formed at the ends of legs 31 with an inwardly turned base portion and with the opening of the J-hooks extending outwardly from a centerline of the cap 30. In this instance shaped flanges 33 are adapted for cooperative engagement with inwardly turned hooked ends 42 of the first rail cap 40.

In this particular embodiment, the reduced length of first flange 25 permits second flange 26 to serve as a fulcrum, or cantilever to facilitate snap fit assembly of the upper rail cap 40 to the lower rail cap 30 to complete the final rail assembly 10. More preferably, first flange 25 is positioned at an upper end of vertical extension 22, such that it may supportively abut shaped flanges 33 as lower rail cap 30 is initially fitted over support member 20 and allow lower rail cap 30 to retain support member therein. During final assembly legs 31 are pinched proximal shaped flanges 33 and are flexed against second flange 26, acting as a fulcrum. The reduced length of first flange 25 permits the free ends of the shaped flanges 33 to clear the free ends of hooked ends 42. Legs 31 are then released and shaped flanges 33 are urged outwardly for cooperative engagement with hooked ends 42. By this arrangement, construction of support member 20 is made simpler and assembly of the rail components is made easier in that the rail caps 30, 40, are designed for simple snap-fit assembly to support member 20.

Figure 11:
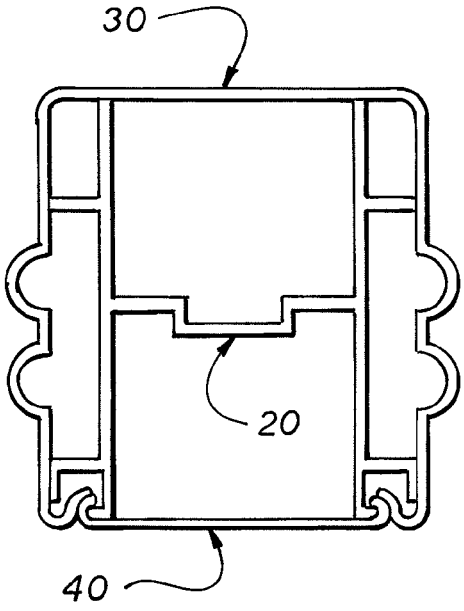
FIG. 11 depicts a cross sectional view of an alternative embodiment of a rail having a plurality of raised ridges.
Figure 12:
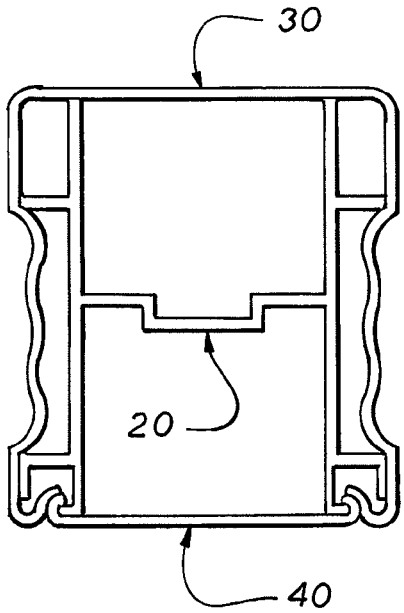
FIG. 12 depicts a cross sectional view of an alternative embodiment of a rail having beveled edges.

An example of the great versatility of designs possibilities for rail 10 may be seen by reference to the shape of the upper rail cap 30 and lower rail cap 40 as shown in FIG. 11. In this instance upper rail cap 30 is again of a generally inverted U-shape having a generally horizontal intermediate portion 32 and legs 31 extending generally vertically therefrom. In the particular example shown intermediate portion 32 has a downward curvature across its width and at the junction of intermediate portion 32 and downwardly extending legs 31. In the particular example shown legs 31 converge inwardly. Shaped flanges 33 extend inwardly from legs 31 for engagement with second flange 26, for securement of upper rail cap 30 to support member 20.

In this example a vertical component is added to lower rail cap 40. Lower rail cap 40 still comprises a substantially flat inner portion 41 and a pair of hooks 42 for engagement with third flanges 27 and securement of lower rail cap 40 to support member 20. However, in this instance lower rail cap 40 includes a medial portion 43 interposed between inner portion 41 and hooks 42. In the particular embodiment shown, medial portion 43 comprises a generally vertical component with the sides bowed inwardly towards a centerline of rail 10. As may also be seen shaped flanges 33 and hooks 42 preferably abut to provide an interference fit between each other and their respective second flange 26 and third flanges 27, facilitating positive securement of upper rail cap 30 and lower rail cap 40 to support member 20. It may be seen that first flange 25 is in abutment with an inner wall of upper rail cap 30 and that the upper ends 23 of extensions 22 and cross piece 21 are in abutment with an inner wall 34 of intermediate portion 32, providing a supporting interface between support member 20 and rail cap 30.

Figure 25A:
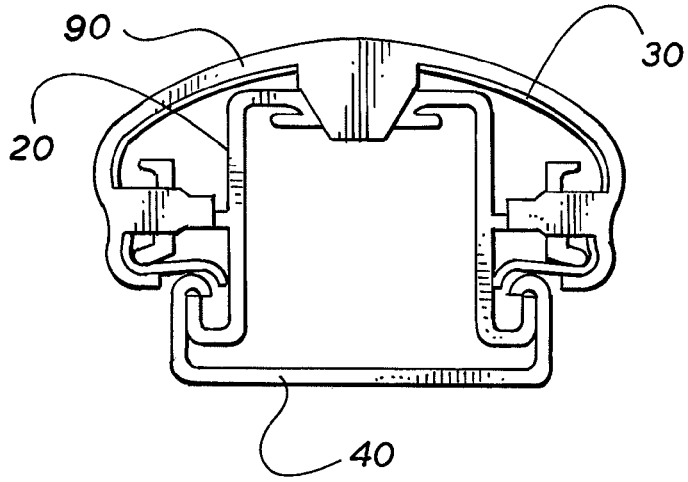
FIG. 25A depicts an end view of an alternative embodiment of a cantilevered rail support and covering.
Figure 25B:
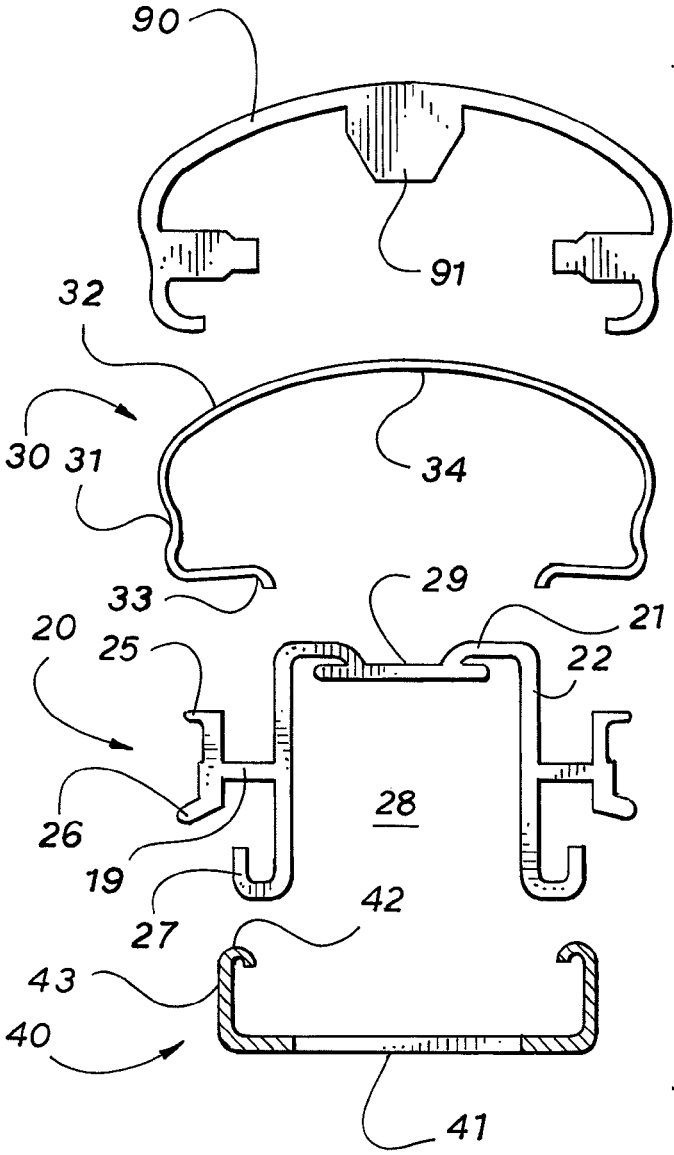
FIG. 25B depicts an expanded view of an alternative embodiment of a cantilevered rail support and covering.
Figure 26:
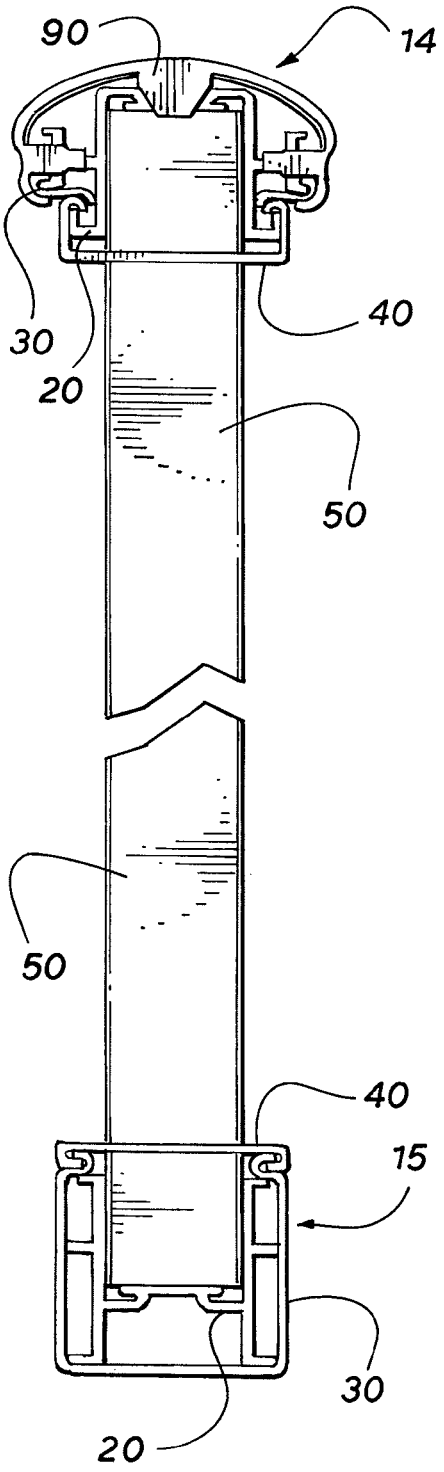
FIG. 26 depicts an end sectional view of an assembled view of a fence section.

In reference to FIGS. 25A-B and 26, an additional embodiment of a rail 10 is further demonstrated. Support member 20 is a generally inverted U-shape with a cross member 21 interconnecting vertical extensions 22. As with those previously described, support member 20 comprises a first flange 27, a second flange 26 and an optional third flange 25. In this instance second flange 26 and third flange 25 extend from a common rib 19 extending outwardly from an intermediate portion of legs 22. As with the previous exemplary embodiment, the hooked ends 42 and shaped flanges 33 of upper rail cap 30 and lower rail cap 40 abut to provide an interference fit between each other and the first 27 and second flange 26. First flange 27 defines as an upwardly opening groove extending along the length of support member 20. Lower rail cap 40 has a pair of downwardly turned hooked ends 42 extending from legs 43. In this instance lower rail cap 40 may be snap-fit to the support member 20 and captively retained by the cooperative engagement of hooked ends 42 with the groove of first flange 27.

Upper rail cap 30 is then fitted over support member 20 such that shaped flanges 33 are pressed into the opening between second flange 26 and hooked ends 42. In this instance second flange 26 acts as a fulcrum to bias shaped flanges 33 in abutment with hooked ends 42.

As will be appreciated by those of skill in the art, upper 30 and lower 40 rail caps can be formed to provide a rail having virtually any desired shape that may be obtained by traditional methods of woodworking, such as routing, as well as and those that may be obtained by traditional metalwork, as in the case of wrought iron and the like.

Having thus described various embodiments of the invention, a preferred method of assembling the components comprising a rail 10, a fence or guard rail section 13, or an entire installation will be described.

As a preliminary matter a property owner or perhaps a construction contractor or subcontractor, may select a desired design for the rail 10 or rails 14 & 15, which may be chosen from either an existing selection of patterns, or it may be specifically designed for the particular application. The desired design for a rail comprises: selecting an upper rail cap 30 design and selecting a lower rail cap 40 design. The desired design for a fence or guardrail section 13 comprises: selecting at least one desired design for rails 14 & 15; and selecting a desired spindle 50 design. The desired spindle design comprises: selecting at least one spindle shape, selecting a spindle spacing pattern, and if more than one spindle shape is selected, selecting a spindle placement pattern.

In instances where the material selected for the upper rail cap 30 and lower rail cap 40 and spindles 50 are plastics or vinyl, the selection of a desired design further comprises selecting a color for each of the selected components.

The particular application will of course define certain parameters such as the length, height and width of the expanse to be enclosed, as well as such factors as the load bearing capacity and strength required of the fence or guardrail 13. Based on the desired design and application parameters, a suitable support member 10, upper rail caps 30 and lower rail caps 40 are selected and cut from stock or formed to the appropriate length. Where required, spindles 50 are cut from stock or formed to the appropriate length, corresponding to the height of the fence or guardrail section 13.

In assembling a rail 10, the upper rail cap 30 is fitted to support member 20 by placing cap 30 over support member 20 and engaging shaped flanges 33 with second flange 26 along the entire length of the rail 10. Lower rail cap 40 is fitted to support member by placing cap 40 in position and engaging hooks 42 with third flange 27.

In assembling a fence or guardrail section, rails 14 & 15 are assembled. Spindles 50 are then inserted in apertures 35 of lower rail 15 and pressed for frictional engagement of the lower spindle ends 52 in channel 28. Upper rail 14 is then placed over the upper spindle upper ends 51, and the spindle ends 51 are aligned with and inserted into apertures 45 of upper rail 14. Upper rail 14 is pressed for frictional engagement of upper spindle ends 52 within channel 28.

Fence or guardrail section 13 is attached to the structure 16 or fence post 17 by attaching brackets 60 to the structure 16 or fence post 17 at the appropriate height such that the legs 62 are in supporting abutment with the lower surfaces of the respective cross pieces 21 at each rail 14 & 15 ends.

Figure 21:
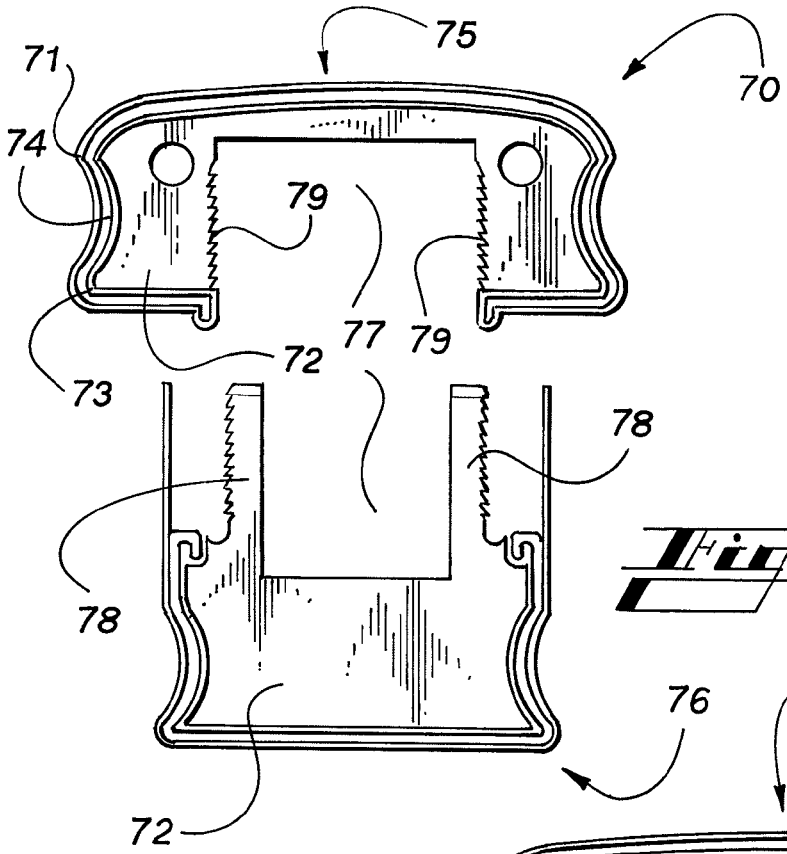
FIG. 21 depicts a frontal view of a backing plate having first and second sections.
Figure 22:
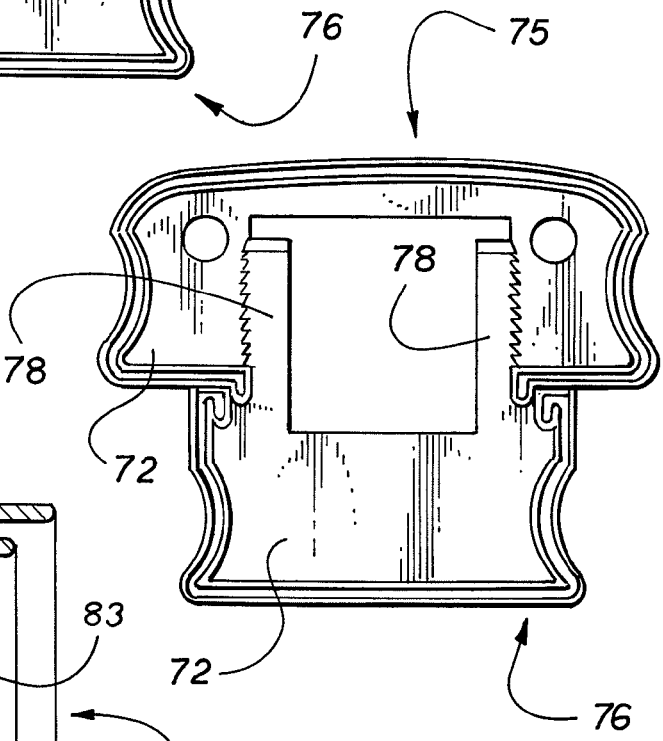
FIG. 22 depicts a frontal view of a backing plate.
Figure 23:
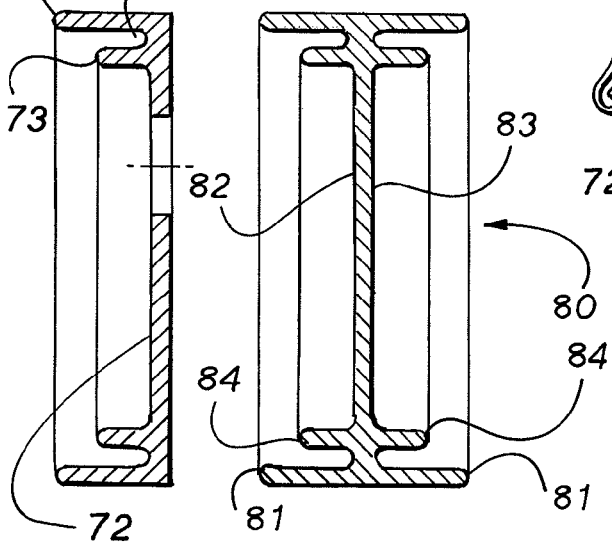
FIG. 23 depicts a side sectional view of a backing plate and a joining plate.

To obtain more attractive finish to the above described installation, a backing plate 70, such as that shown in FIGS. 21-23, may be provided. As may be seen backing plate 70 is shaped to correspond to the periphery of the end of rail 10. Backing plate 70 is substantially flat and has a raised outer ridge 71 defined around the periphery and extending from a face 72 of plate 70. An optional second inner ridge 73 extends from face 72 and inscribes outer ridge 71, defining a groove 74. Groove 74 receives the ends of upper rail cap 30 and lower rail cap 40. The height of outer ridge 71 is selected to overlap the outer surface of rail caps 30 & 40, to avoid unsightly gaps and obviate the need for the application of caulk. A plurality of apertures may be defined in face for receiving bolts or screws to secure backing plate 70 to the wall 16 or structure 16. Alternatively, backing plate 70 is of a two piece construction, having first 75 and second 76 interlocking sections. First section 75 corresponds to the periphery of upper rail cap 30 and second section 76 corresponds to the periphery of lower rail cap 40. A notch 77 is defined in faces 72 along adjoining edges of sections 75 & 76. As shown a keyed extension 78 extends from the edge of second section 76 that adjoins first section 75. Keyed extensions 78 are received in and engage a corresponding keyed edge 79 defined in the notch 77 of first section 75. This dual piece arrangement permits the insertion of backing plate 70 after the installation and attachment of rail 10. Should an unusually large gap between any particular rail 10 end be present, a spacer or shim, essentially shaped as is backing plate 70 without ridges 71 & 72, may be inserted between backing plate 70 and wall 16.

Figure 27:
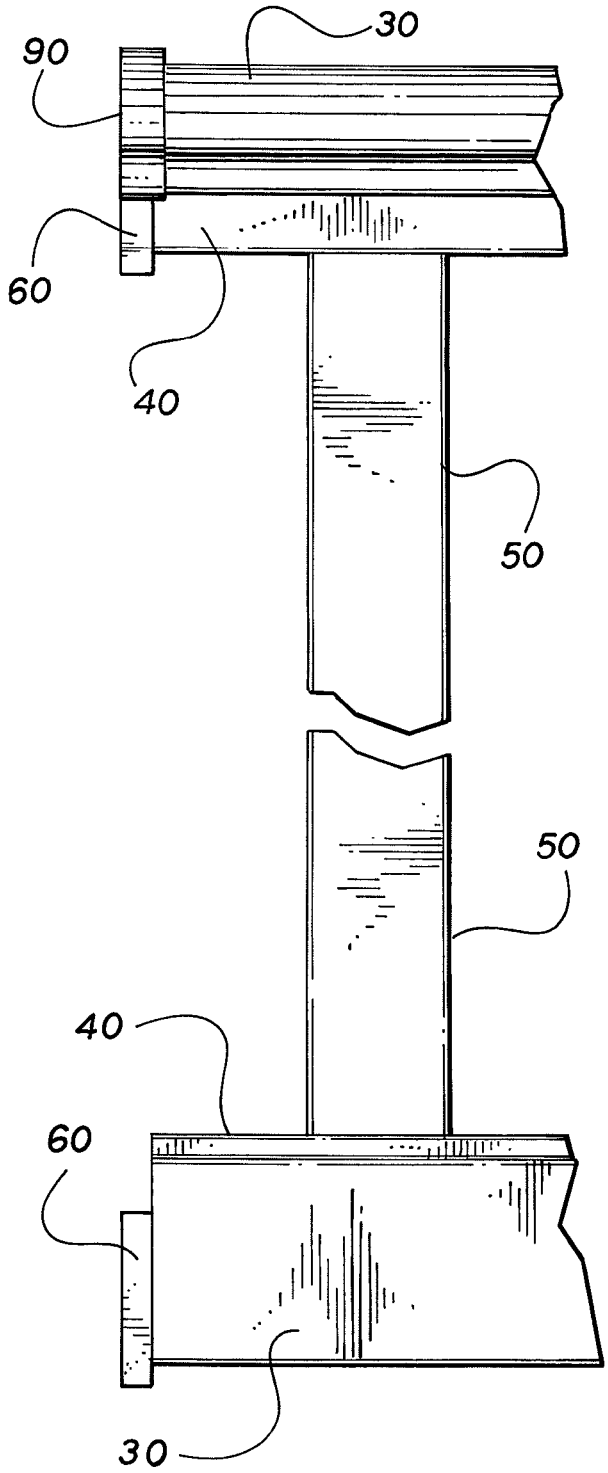
FIG. 27 depicts a frontal view of an assembled fence section.

Alternatively, as may be seen in reference to FIGS. 25 and 27, an end cap 90, shaped to overly the upper rail cap 40 may be snap fit to fill unsightly gaps and partially cover bracket 60. A plurality of fingers 91 extending from an inner surface of end cap 90 assist in retaining end cap 90 in place on the finished rail.

While the preferred fabrication of upper 30 and lower 40 rail caps is by sheet forming such that even particularly long sections of these elements may be fabricated without unsightly seams, the invention also contemplates that upper 30 and lower 40 rail caps may be pre-fabricated in various lengths as stock material. Indeed, an entire kit of materials for a fence or guard rail section or even individual components may be provided, such as for do-it-yourself projects sold through catalogs, home improvement stores, or other retail outlets. With pre-fabricated components and kits, it would be desirable that elements be joined for enclosing particularly long expanses or in instances where it is desirable to recover materials that would otherwise be scrap. To enhance the appearance of a seam between adjacent upper 30 and lower 40 rail caps, a joining plate 80, may be utilized. Joining plate 80, is substantially identical to the previously described backing plate 70, except that joining plate 80 has a first outer ridge 81 and second ridge 84 defined on both a front face 82 and a back face 83 of the joining plate 80, with ridges 81 and 84 defining a groove 85 on each face. Joining plate 80 may also be of a two piece construction as described for that of the backing plate 70.

Figure 13:
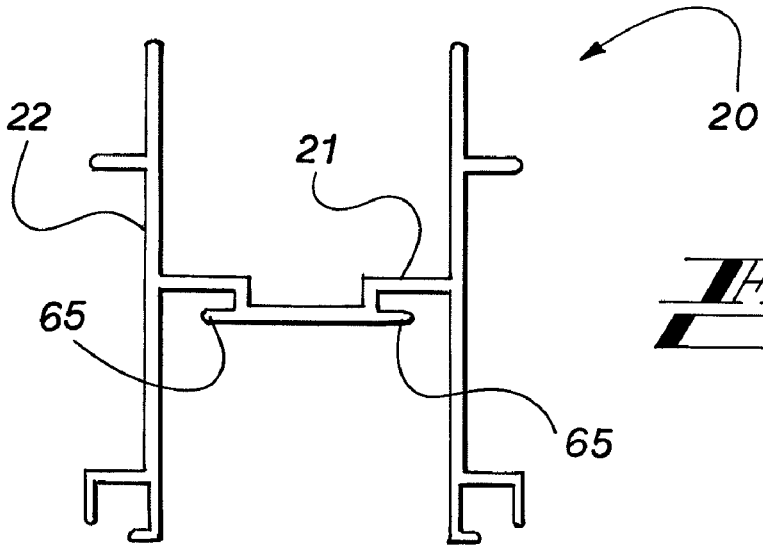
FIG. 13 depicts a cross sectional view of a support member having an optional extender key.
Figure 14:
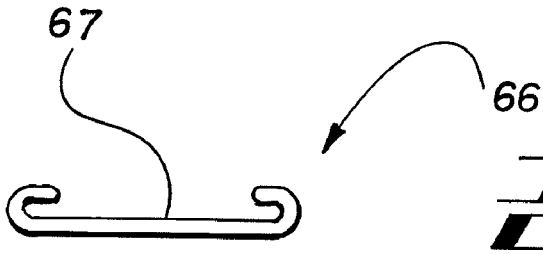
FIG. 14 depicts a cross sectional view of an extension slide.
Figure 15:
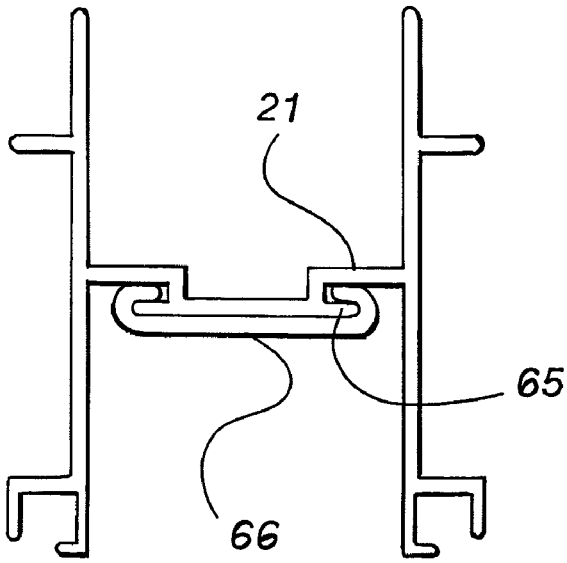
FIG. 15 depicts a cross sectional view of a support member having an optional extender key and an extension slide coupled to the extender key.
Figure 16:
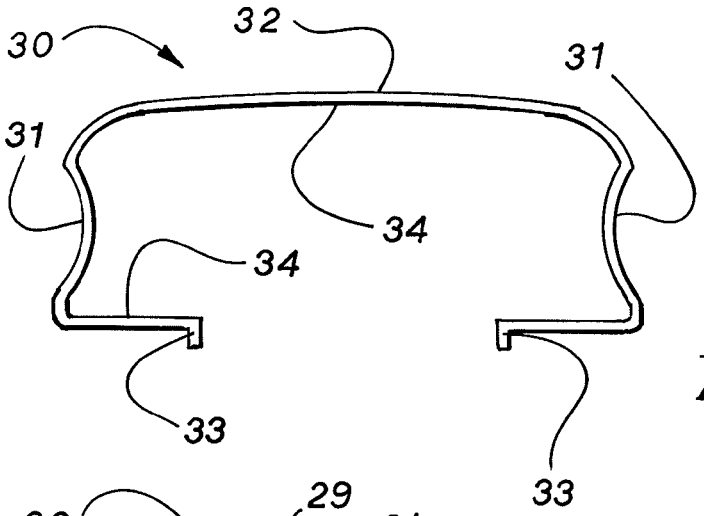
FIG. 16 depicts a cross sectional view of an alternative embodiment of a rail cap having convex sides and a concave intermediate portion.
Figure 17:
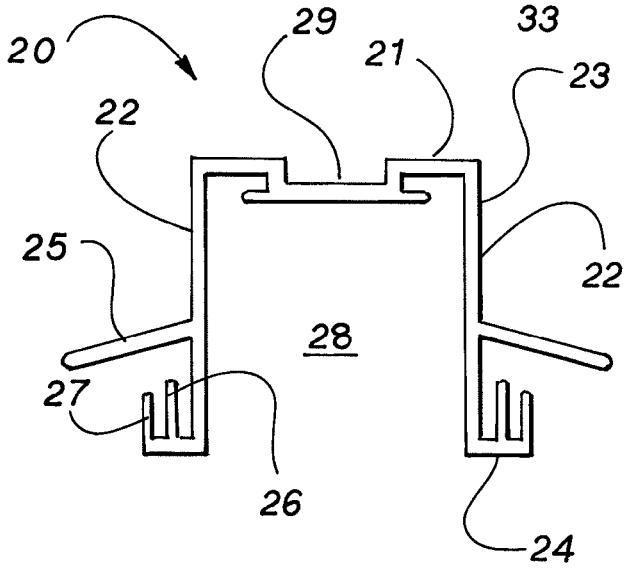
FIG. 17 depicts a cross sectional view of an alternative embodiment of a support member.
Figure 18:
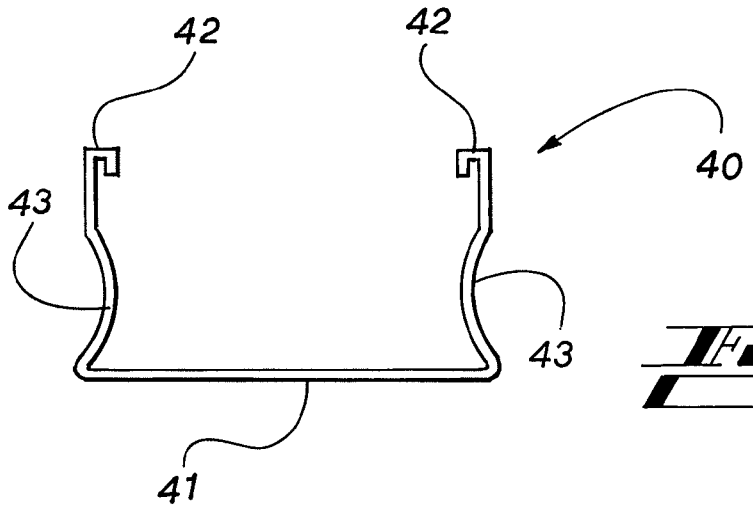
FIG. 18 depicts a cross sectional view of an alternative embodiment of a lower rail cap having legs.

Unlike that of caps 30 & 40, fabrication of support member 20 will likely involve prefabrication of the same to standard lengths of stock material, such as 4', 8', 10' or 12' lengths or even custom manufactured to meet the needs of the particular application. In situations where standard length materials are used, fabrication of a particularly long rail section 10 may require a method of joining a plurality of support members 20, whether complete stock lengths, or lengths cut to fit the remaining portion of a particular expanse, a means of joining adjacent support members 20 is desirable. As may be seen in reference to FIGS. 13-15, support member 20 may be further modified to include a keyed extension flange 65. In a preferred embodiment shown, keyed extension flange 65 extends from a lower surface edge of cross piece 21 at the base of secondary channel 29. However, keyed extension flange 65 may extend from any interior wall of channel 28.

To provide the greatest flexibility in fitting rails 10 to the greatest variety of expanses, keyed flange 65 preferably extends the entire length of support member 20, such that a joint may be formed at any particular length that support member 20 may be cut. A keyed extension slide 66 is used to join adjacent keyed extension flanges 65. Keyed extension slide 66 is an elongate member formed with a channel 68 defined therein to receive keyed extension flange 65, and has a length and thickness selected to provide sufficient strength to the joint. In joining adjacent support members 20, keyed extension slide 66 is fitted over the keyed extension flange 65 of a first support member 20 and is then fitted to receive the keyed extension flange 65' of a second support member 20'. In those instances where the application precludes joining adjacent support members 20 & 20' prior to their placement in the expanse, extension slide 66 may fitted such that its entire length is placed over the first keyed extension flange 65, the second support member 20' is then placed in abutment with first support member 20, and extension slide 66 is then fitted to second extension flange 65'. Extension slide 66 may then be affixed to support members 20 & 20' by any conventional means such as screws, bolts, pins, welds, adhesives.

It should be understood that although examples of preferred embodiments of the invention have been disclosed herein in some detail, modifications and variations might be made without departing from the spirit and scope of the invention. Accordingly, all forms of the invention are claimed that come within the scope of the appended claims.

What is claimed is:

1. A rail comprising: an elongate rigid support member; a first rail cap enclosing a portion of the support member; and a second rail cap enclosing a remaining portion of the support member;

a. said elongate rigid support member comprising: a cross piece interconnecting opposed vertical extensions defining at least one channel, the elongate rigid support member further comprising a first pair of ribs and a second pair of ribs extending outwardly from the vertical extensions in spaced relation to one another;

b. the first rail cap comprising an inner portion and a pair of inwardly turned hooks extending from ends of the inner portion towards a center line of the first rail cap engaging the first pair of ribs, c. the second rail cap comprising an intermediate portion, a pair of legs extending from ends of the intermediate portion, and a pair of shaped flanges extending initially inwardly from the legs towards a center line of the second rail cap and then turning outwardly therefrom, d. wherein the second pair of ribs define a fulcrum acting upon an inner surface of the second rail cap to bias the shaped flanges in abutment with the first rail cap.

2. The rail of claim 1 wherein the shaped flanges are biased in interlocking abutment with the inwardly turned hooks.

3. The rail of claim 1 wherein the second pair of ribs bias the shaped flanges in abutment with the inwardly turned hooks.

4. The rail of claim 1 wherein the first pair of ribs extend from a lower portion of the vertical extensions and the second pair of ribs extend from a point intermediate an upper end of the vertical extensions and the first pair of ribs.

5. The rail of claim 4 wherein the first pair of ribs extend outwardly from the vertical extension by an amount less than that of the second pair of ribs.

6. The rail of claim 4 wherein the second pair of rib like flanges are in abutment with an inwardly turned portion of the shaped flanges.

7. The rail of claim 4 wherein the cross member extends between a point proximal the upper ends of the vertical extensions.

8. The rail of claim 1, wherein the inwardly turned hooks open downwardly relative a centerline of the first rail cap.

9. The rail of claim 1, wherein said first rail cap further comprises at least one aperture in a surface intermediate the hooked ends and subjacent said channel, said aperture and channel dimensioned to receive an end of an elongate spindle.

10. The rail of claim 1 wherein the first paired ribs define a groove along a lower portion of the vertical extensions, such that the inwardly turned hooks cooperatively engage the groove.

11. The rail of claim 10 wherein said biased shaped flanges urge said hooked ends into said groove.

12. A rail comprising an elongate rigid support member, a first rail cap enclosing a portion of the elongate rigid support member, and a second rail cap enclosing a remaining portion of the elongate rigid support member, a. the elongate rigid support member comprising a first set of paired ribs extending outwardly from a lower portion of the opposed sides, a second set of paired ribs extending outwardly from an intermediate portion of the opposed sides;

b. the first rail cap comprising hooked ends turned inwardly towards a centerline of the first rail cap engaging the first pair of ribs; and c. the second rail cap comprising shaped flanges opening outwardly from a centerline of the second rail cap and disposed for cooperative engagement with the hooked ends.

13. The rail of claim 12, a second set of paired ribs extend outwardly from an intermediate portion of the opposed sides, wherein the first paired ribs extend a shorter distance than the second paired ribs.

14. The rail of claim 12 wherein said elongate rigid support member further comprises a cross member interconnecting the opposed sides defining a channel.

15. The rail of claim 14 wherein first rail cap further comprises at least one aperture defined in a surface intermediate the hooked ends and subjacent said channel, said aperture and channel dimensioned to receive an end of an elongate spindle.

* * * * *